United States Patent [19]

Abei

[11] 4,069,109

[45] Jan. 17, 1978

[54] METHOD FOR AUTOMATIC, CONTINUOUS SELECTIVE PLATING ON A TAPE MEMBER

[76] Inventor: Hiroko Abei, Fujisawashi, Japan

[21] Appl. No.: 672,512

[22] Filed: Mar. 31, 1976

[51] Int. Cl.[2] ..... C25D 5/02; C25D 5/08; C25D 5/34

[52] U.S. Cl. ..... 204/15; 204/28

[58] Field of Search ..... 204/15, 224 R, 28, 32 R, 204/34

[56] References Cited

U.S. PATENT DOCUMENTS

| | | | |
|---|---|---|---|
| 3,294,664 | 12/1966 | Franklin | 204/224 R |
| 3,723,283 | 3/1973 | Johnson et al. | 204/224 R |
| 3,860,499 | 1/1975 | Graham et al. | 204/224 R |
| 3,974,056 | 8/1976 | Jogwick | 204/224 R |

*Primary Examiner*—T. M. Tufariello

[57] ABSTRACT

The present invention relates to a method to effect a selective plating automatically and continuously in order to make connecting elements such as connectors or contact elements such as relays. More particularly it relates to a method to conduct a selective plating automatically and continuously at least on one of the upper and lower surfaces of a metal strip member unfolded from a roll, wherein the metal strip is moved intermittently in one direction correspondingly with the intervals at which at least one cleaning nozzle, one vacuum nozzle and one plating nozzle are linearly arranged while it is kept pressed onto the tips of the nozzles.

6 Claims, 3 Drawing Figures

METHOD FOR AUTOMATIC, CONTINUOUS SELECTIVE PLATING ON A TAPE MEMBER

BACKGROUND OF THE INVENTION

In recent years the electronic technology has rapidly advanced. Along with the technical advancement the electronic devices are more miniaturized and more generally incorporated in ICs. Further along with such tendency electric signals used in the electronic devices have their amplitudes made smaller. The amplitude of an electric signal being so small, the characteristics of the device inevitably depends largely on the characteristics of connecting elements of the device. Accordingly, the electric resistance at the connecting and contact elements should be reduced as much as possible. To reduce the resistance it becomes necessary to form the connectors, the relays and the like by selective plating. Selective plating is strongly desired particularly in manufacturing measuring devices and data processing units (CPU) which need electrical characteristics of high precision. In this case, plating is effected selectively on only those portions of the connectors and the contact which are to contact with conductors. The connectors and the contacts need only be entirely plated. Namely, the selective plating is carried out to improve the electric resistance of the whole device.

Selective plating is employed for another reason. As plating metal precious metals such as gold and platinum are generally used since their electrical resistivity is low. If the portion of each connector or each relay other than contacting area is plated with such an expensive metal as well, the finished device would become costly. This is why only the contacting portion of each connector or relay is plated as mentioned before.

Usually, the connecting and contact elements are formed in the following manner. First, selective plating is effected on the upper surface of a metal strip, leaving thereon spot-like layers of a precious metal at regular intervals. Then the unnecessary portion of each spot-like metal layer is cut off by punching so that a metal layer of desired shape and size may obtained. It is difficult, however, to plate such spot-like metal layers at regular intervals on the upper surface of a metal strip. Consequently, an electronic device of high precision could not be manufactured at a low cost.

Accordingly, one object of the present invention is to provide a method and an apparatus which make it possible to plate a metal strip selectively in an automatic and continuous process.

Another object of the present invention is to provide a method and an apparatus for automatic selective plating wherein the selective plating can be conducted on both the upper surface and the lower surface of a metal strip continuously.

Still another object of the present invention is to provide a method and an apparatus for automatic, continuous selective plating on a metal strip, wherein the plating is precisely carried out though the apparatus is small-sized.

Still another object of the present invention is to provide a method and an apparatus for automatic, continuous selective plating on a metal strip, wherein the plating can be carried out, using a small amount of treatment liquids.

Further one object of the present invention is to provide a method and an apparatus for automatic, continuous selective plating on a metal strip, wherein the pattern of the plating layers can be changed very easily.

Another object of the present invention is to provide a method and an apparatus for automatic, continuous selective plating on a metal strip, wherein the thickness of the plating layers can be regulated easily.

Still another object of the present invention is to provide a method and an apparatus for automatic, continuous selective plating on a metal strip, wherein both the primary plating and the finish plating can be carried out easily.

Still another object of the present invention is to provide a method and an apparatus for automatic, continuous selective plating on a metal strip, wherein the thickness of the primary plating layers and that of the finish plating layers can be easily regulated independently of each other.

Further another object of the present invention is to provide a method and an apparatus for automatic, continuous selective plating on a metal strip, wherein the cleaning can be easily made after plating process.

SUMMARY OF THE INVENTION

A method and an apparatus which effects a selective plating on a metal strip automatically and continuously, wherein the metal strip is moved intermittently in one direction correspondingly with the intervals at which at least one cleaning nozzle, one vacuum nozzle and one plating nozzle are linearly arranged, while it is kept pressed onto the tips of the nozzles and supplied with the treatment liquids.

DESCRIPTION OF THE PREFERRED EMBODIMENTS

Figure 1:
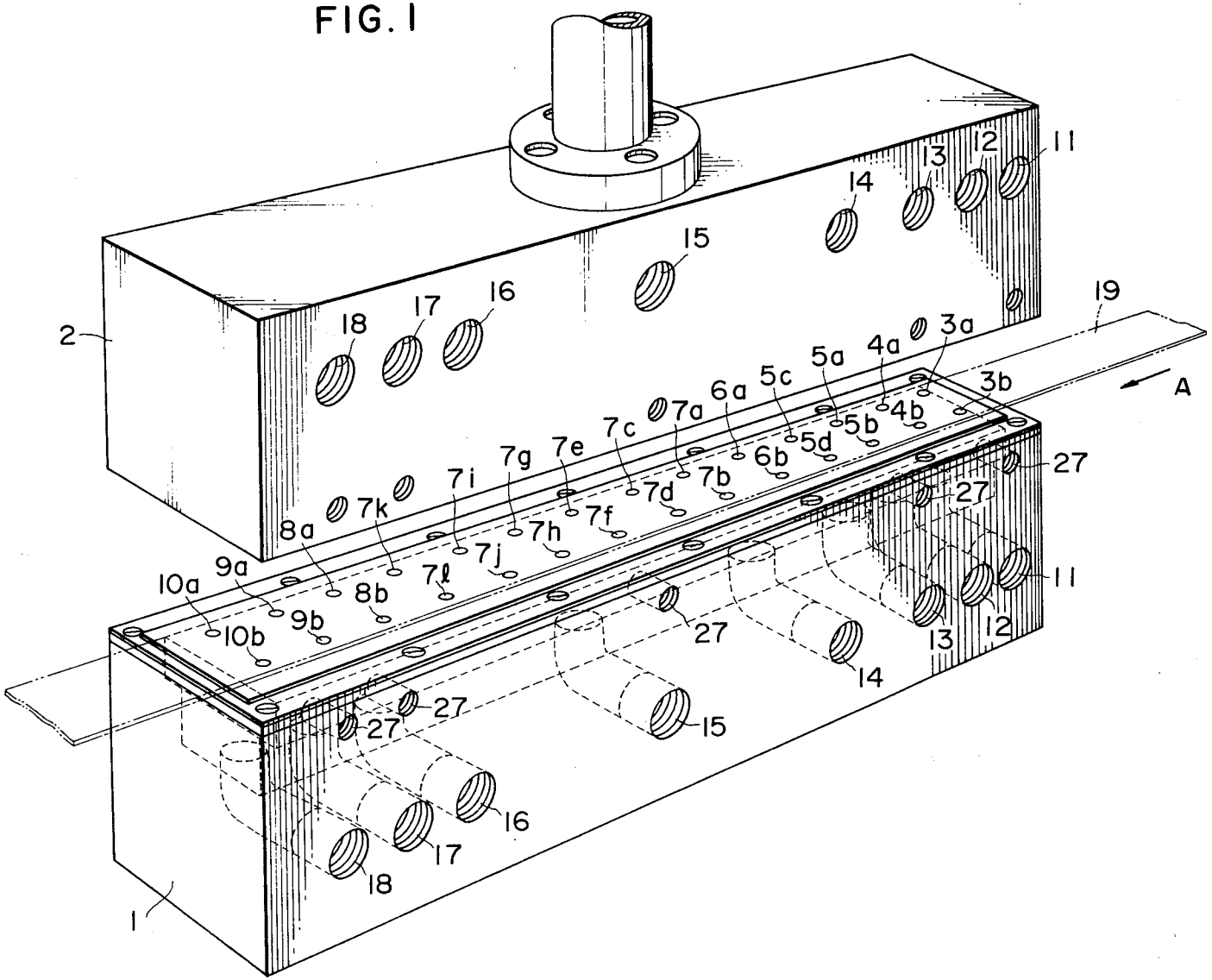
FIG. 1 is a perspective view showing one embodiment and one example of the appartus and the method according to the present invention.

The apparatus for automatic, continuous selective plating on a metal strip according to the present invention comprises, as shown in FIG. 1, a lower plating section 1 of a rectangular shape and a upper plating section 2 shaped similar to the lower plating section 1, so positioned as to face the same and moved up and down by drive means (not shown) such as a hydraulic mechanism. Each of these plating sections 1 and 2 has cleaning nozzles 3*a* and 3*b*, vacuum nozzles 4*a* and 4*b*, primary plating nozzles 5*a* to 5*d*, other vacuum nozzles 6*a* and 6*b*, finish plating nozzles 7*a* to 7*l*, another pair of vacuum nozzles 8*a* and 8*b*, cleaning nozzles 9*a* and 9*b* and another pair of vacuum nozzles 10*a* and 10*b*. The cleaning nozzles 3*a* and 3*b* communicate with a cleaning liquid supply port 11, the vacuum nozzles 4*a* and 4*b* with a vacuum port 12, the primary plating nozzles 5*a* and 5*d* with a primary plating liquid supply port 13, the vacuum nozzles 6*a* and 6*b* with another vacuum port 14, the finish plating nozzles 7*a* and 7*l* with a finish plating liquid supply port 15, the vacuum nozzles 8*a* and 8*b* with another vacuum port 16, the cleaning nozzles 9*a* and 9*b* with a cleaning liquid supply port 17, and the vacuum nozzles 10*a* and 10*b* with a vacuum port 18. These nozzles are arranged in two lines at regular intervals. On these nozzles a metal strip 19 is moved intermittently in the direction indicated by arrow A, by a feeding mechanism (not shown).

Figure 2:
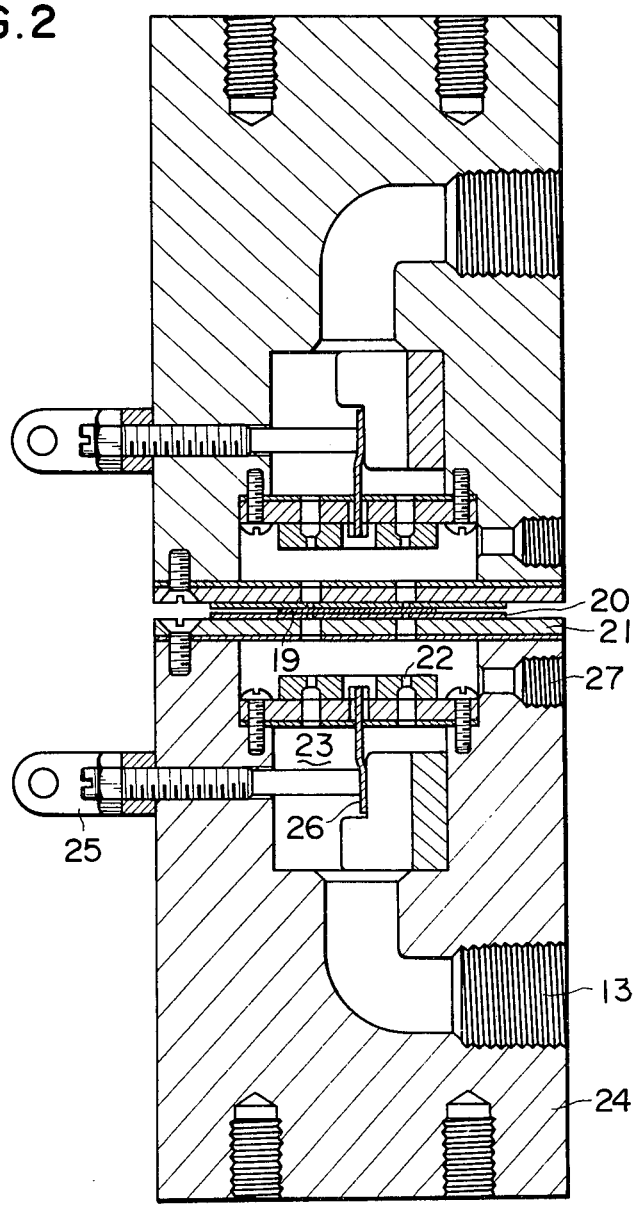
FIG. 2 is a cross-sectional view of the embodiment of apparatus as illustrated in FIG. 1.

In each of the upper and lower plating sections 2 and 1, the primary plating nozzles 5*a* and 5*d* and the finish plating nozzles 7*a* and 7*l* have an identical configuration. For example, the primary plating nozzles 5*a* and 5*d* are shaped as illustrated in FIG. 2. That is, they have such openings whose shape coincides with any desired shape of plating layers to be formed. Moreover, they are so disposed as to have their openings meet the holes made in a masking plate 20 which possesses some elasticity and which is supported on a masking plate holder 21. Jet nozzles 22 eject the plating liquid from the primary plating liquid supply port 13 onto the metal strip 19 through the holes of the masking plate 20 are provided in a recess 23 formed in the housing 24. Namely, through the recess 23 the plating liquid is guided from the supply port 13 to the jet nozzles 22. Further, the recess 23 guides to the supply port 13 the excessive plating liquid which is sprayed back from the surfaces of the metal strip 19. The recess 23 is covered up with the masking plate holder 21. With recess 23 a plating liquid outlet port 27 communicates, which is formed also in the housing 24. A terminal 25 through which to apply D.C. current for plating penetrates the housing 24 into the recess 23. Connected to the terminal 25 is an anode plate 26 which extends to the jet nozzles 22. The nozzles 22, the recess 23, the plating liquid outlet port 27, the terminal 25, the anode plate 26 and the primary plating liquid supply port 13 are positioned in symmetry in the upper and lower plating sections 2 and 1 with respect to the metal strip 19.

Except for the terminals 25 and the anode plates 26, all the elements in support of the primary and finish plating nozzles 5*a* to 5*d* and 7*a* to 7*d* are made of a synthetic region, e.g. vinyl chloride, which is not affected by the plating liquid. The cleaning nozzles 3*a* and 3*b* and the other pair of cleaning nozzles 9*a* and 9*b* are supported by elements similar in construction and arrangement to those for the primary and finish plating nozzles, though neither terminals 25 nor anode plates 26 are provided for them. The vacuum nozzles 4*a*, 4*b*, 6*a*, 6*b*, 8*a*, 8*b*, 10*a* and 10*b* have no supporting elements. They are simply communicating with the vacuum ports 12, 14, 16 and 18, respectively.

It shall now be explained in detail how the plating apparatus of the above-mentioned construction is operated.

Once set in the feeding mechanism (not shown), the metal strip 19 is moved on the nozzles intermittently at a pitch equal to the intervals at which the nozzles are arranged. While the tape stands still momentarily, the upper plating section 2 which has been lowered by the drive means (not shown) such as a hydraulic mechanism pushes the metal strip 19 on the lower plating section 1, thus clamping the metal strip 19 between the sections 1 and 2. At the same time the metal strip 19 is applied with negative potential. When the metal strip 19 is clamped between the sections 1 and 2, solenoid valves (not shown) are opened synchronously, thus supplying the cleaning liquid to the jet nozzles through the cleaning liquid supply ports 11 which communicates with the cleaning nozzles 3*a* and 3*b*. The cleaning liquid is ejected from the jet nozzles and washes those portions of the both surfaces of the metal strip 19 which face the holes of the masking plates 20. The used cleaning liquid is collected through the cleaning liquid outlet ports 27. This done, a solenoid valve is opened to make the vacuum ports 12 communicate with a vacuum pump (not shown). Thus, through the vacuum nozzles 4*a* and 4*b* the moisture on the both surfaces of the tape member is sucked up, thereby drying these surfaces. Upon completion of the drying the primary plating liquid is supplied through the primary plating liquid supply ports 13 and eventually ejected from the jet nozzles 22 associated with the primary plating nozzles 5*a* to 5*d*. The ejected primary plating liquid is blown hard against the surfaces of the metal strip 19 through the holes of the masking plates 20. During the liquid ejection the anode plates 26 are applied with positive potential while the metal strip 19 is applied with negative potential. As a result, only those portions of the surfaces of the metal strip 19 which correspond to the holes of the masking plates 20 are plated and covered with a primary plating layer.

The holes of the masking plates 20 communicating with the primary plating nozzles 5*a* to 5*d* are made in a shape corresponding to the desired shape of plating layers to be formed on the metal strip 19. Thus if the shape of the plating layers is to be changed, it is sufficient to make these holes in a different shape. The primary plating nozzles 5*a* and 5*b* are arranged side by side across the metal strip 19, while the primary plating nozzles 5*c* and 5*d* are also juxtaposed across the metal strip 19 but spaced from the nozzles 5*a* and 5*d* in the direction of the intermittent movement of the metal strip 19. This means that the same portion of the metal strip 19 undergoes the primary plating two times and covered with two plating layers. Thus it is possible to control freely the thickness of the resultant plating layer, merely by providing less or more pairs of primary plating nozzles.

In the next process, i.e. finish plating, the finish plating liquid is supplied through the finish plating liquid supply ports 15 in the same manner as in the primary plating. Then, as in the primary plating, the metal strip 19 is plated on both surfaces at only portions which correspond to the finish plating nozzles 7*a* to 7*l*, six pairs of nozzles spaced from one another in the lengthwise direction of the metal strip 19. The used finish plating liquid is collected through the liquid outlet ports 27, and again supplied to the finish plating nozzles 7*a* and 7*l* and thus re-used. Upon completion of the finish plating the vacuum ports 16 are made to communicate with the vacuum pump by the opening of said solenoid valve. Then, the moisture on the plated portions of the metal strip 19 is sucked up, and the metal strip 19 is dried. Thereafter the cleaning liquid is supplied through the cleaning liquid supply ports 17 to the cleaning nozzles 9*a* and 9*b*. The plated portions of the metal strip 19 which face the cleaning nozzles 9*a* and 9*b* are washed with the cleaning liquid. When the washing is finished, the vacuum port 18 is made to communicate with the vacuum pump (not shown) so that the plated portions of the metal strip 19 facing the vacuum nozzles 10*a* and 10*b* are dried as the moisture on them is sucked up.

Since the pairs of nozzles are arranged linearly at regular intervals equal to the pitch at which the metal strip 19 is intermittently fed in one direction, when all the above-mentioned steps are completed the surfaces of the metal strip 19 are plated at portions and at the pitch of the intermittent feeding. To move the metal strip 19 one step forward, all the solenoid valves are closed, and then the upper plating section 2 is lifted to free the metal strip 19 from the clamped state.

If the upper plating section 2 is not used, the metal strip 19 may be pushed against the lower plating section 1 by a pressing mechanism.

With the method comprising the above-mentioned steps and the apparatus of the above-mentioned construction it is possible to conduct plating accurately only on the resired portions of a metal strip. Further, the apparatus can be made small, and yet can effect selective plating with a high efficiency, using a small amount of treatment liquids. Still further, since the vacuum step is interposed between the plating step and the cleaning step, the cleaning can be carried out both easily and unfailingly.

Figure 3:
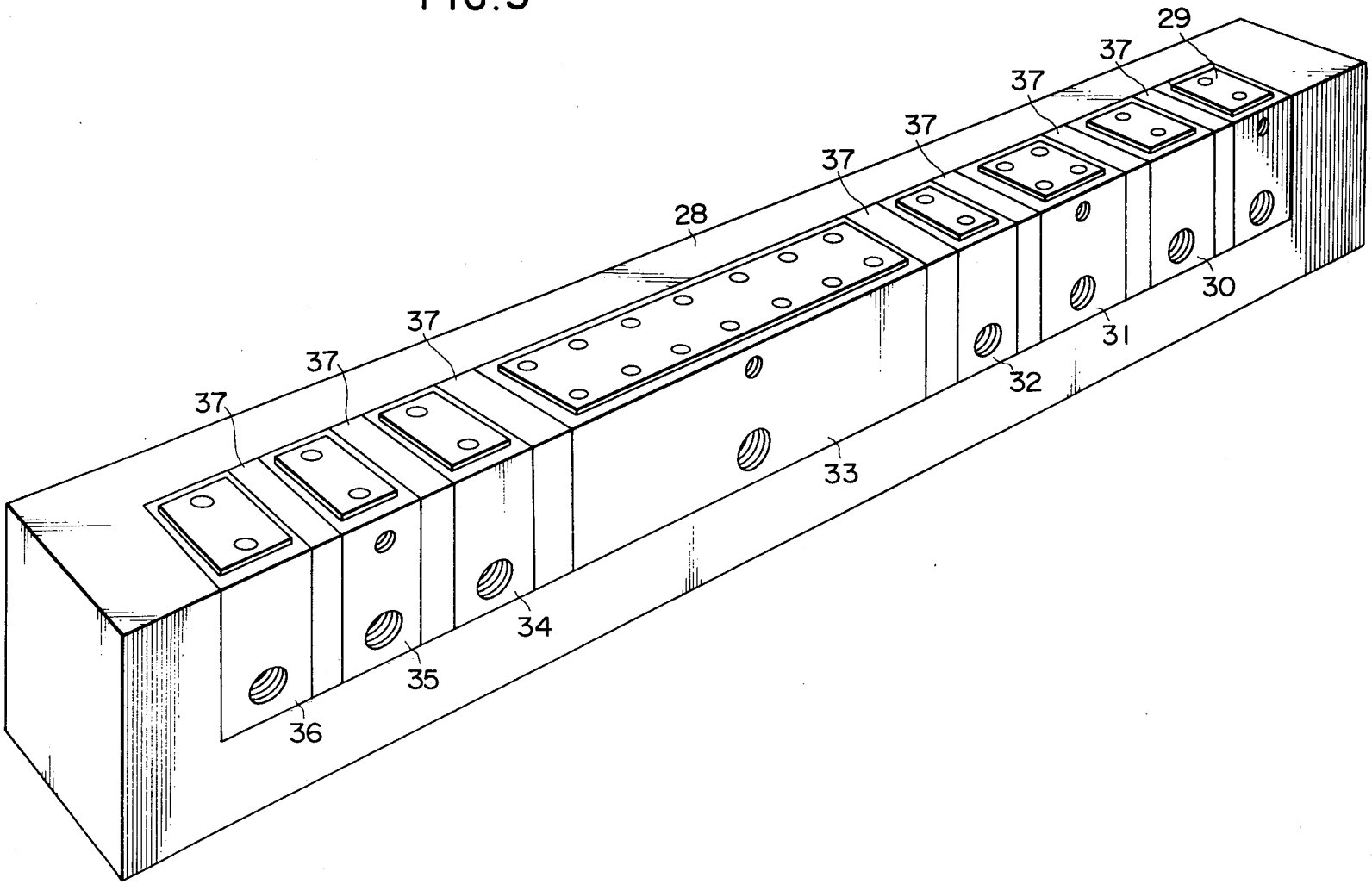
FIG. 3 is a perspective view of another embodiment of the present invention.

FIG. 3 is a perspective view of the lower plating section of another embodiment of the present invention. In this embodiment the nozzles used in the same step are formed in a single block, and each block is set in the recess made in the housing 28. More specifically, in the recess a first cleaning unit 29, a first vacuum unit 30, a primary plating unit 31, a second vacuum unit 32, a finish plating unit 33, a third vacuum unit 34, a second cleaning unit 35 and a fourth vacuum unit 36 are set with spacers 37 inserted between them. Spacers 37 are interposed between the units so that the pitch of the resultant plating layers may be regulated. Of course, they need not be used if the pitch of the plating layers is not changed. Each unit is so fitted in the recess as to have its liquid supply ports, vacuum port, liquid outlet port, power terminal etc. connected properly to those formed in the housing 28. Accordingly, the change of plating layer shape or change of the thickness of resulant plating layers can be achieved by replacing one unit with another unit whose masking plate 20 has smaller or larger holes or which has more or less pairs of nozzles.

As mentioned above, the method and apparatus according to the present invention can effect selective plating of high precision easily and continuously since only the portions of a metal strip which are to be plated are made to contact the nozzles for various treatments. Further the nozzles employed in the same step are formed in a single unit, and the units necessary to effect the treatments are fitted or combined thereby to carry out the selective plating. Thus, to change the shape and/or thickness of the plating layers it is sufficient to replace one unit with another of a different size. Moreover, it is possible to effect selective plating simultaneously on both surfaces of a tape member only by positioning the nozzles for various treatments on both surface of the metal strip.

What is claimed is:

1. A method for automatic, continuous selective plating on a metal strip, comprisng intermittently moving said metal strip in one direction at a predetermined pitch, intermittently engaging at least one or more desired portions of said metal strip with at least one cleaning nozzle, one vacuum nozzle and one plating nozzle which have a shape corresponding to the desired shape of plating layers to be formed and which are arranged linearly at intervals equal to the pitch of the intermittent movement of said metal strip and cleaning, vacuuming and plating said metal strip intermittently only at said desired portions on said metal strip.

2. A method according to claim 1, further comprising:

intermittently engaging only said desired portions of said metal strip with at least one finish plating nozzle subsequent to said plating, and finish plating only said desired portion.

3. A method according to claim 1, further comprising:

removably mounting said plating nozzle such that the shape or thickness of resulting plating on said metal strip is changed.

4. A method according to claim 1, wherein:

said plating step includes plating both an upper and lower surface of said strip.

5. A method according to claim 1, wherein:

said plating step includes first and second primary plating and a plurality of finish platings subsequent to said primary plating.

6. A method according to claim 5, further comprising:

vacuuming said desired portions on said metal strip subsequent to said primary plating and prior to said finish platings.

* * * * *

UNITED STATES PATENT AND TRADEMARK OFFICE

CERTIFICATE OF CORRECTION

PATENT NO. : 4,069,109

DATED : January 17, 1978

INVENTOR(S) : Abei

It is certified that error appears in the above-identified patent and that said Letters Patent are hereby corrected as shown below:

Please insert the following information:

--[30] Foreign Application Priority Data

Feb. 13, 1976 Japan.....51-14591--

Signed and Sealed this

Eighth Day of August 1978

[SEAL]

*Attest:*

RUTH C. MASON
*Attesting Officer*

DONALD W. BANNER
*Commissioner of Patents and Trademarks*